US005460740A

United States Patent [19]

Migdal et al.

[11] Patent Number: 5,460,740

[45] Date of Patent: Oct. 24, 1995

[54] ACYLATED MONO AND/OR BIS-SUCCINIMIDES LUBRICATING OIL ADDITIVES

[75] Inventors: Cyril A. Migdal, Croton-on-Hudson, N.Y.; Willy P. Broeckx, Rumst, Belgium; John F. Lucas, Campbell Hall, N.Y.

[73] Assignees: Texaco Inc., White Plains, N.Y.; S.A. Texaco Belgium N.V., Belgium

[21] Appl. No.: 265,669

[22] Filed: Jun. 22, 1994

Related U.S. Application Data

[63] Continuation of Ser. No. 636,479, Dec. 31, 1990, abandoned.

[51] Int. Cl.[6] ..... C10M 133/16; C10M 149/00

[52] U.S. Cl. ..... 252/51.5 A; 252/49.6

[58] Field of Search ..... 252/51.5 A, 49.6

[56] References Cited

U.S. PATENT DOCUMENTS

| | | | |
|---|---|---|---|
| 3,185,704 | 5/1965 | Kahn et al. | 44/347 |
| 3,903,005 | 9/1975 | Kablaoui et al. | 252/392 |
| 3,905,781 | 9/1975 | Dorn | 585/12 |
| 4,127,493 | 11/1978 | Elliott et al. | 252/51.5 A |
| 4,253,979 | 3/1981 | Alexander et al. | 252/51.5 A |
| 4,482,464 | 11/1984 | Karol | 252/51.5 A |
| 4,486,573 | 12/1984 | Hayashi | 252/56 R |
| 4,511,366 | 4/1985 | Burrows et al. | 252/392 |
| 4,686,054 | 8/1987 | Wisotsky et al. | 252/33.4 |
| 4,699,724 | 10/1987 | Nalesnik et al. | 252/56 R |
| 4,927,562 | 5/1990 | Karol et al. | 252/51.5 A |
| 5,062,980 | 11/1991 | Migdal | 252/51.5 A |

*Primary Examiner*—Margaret Medley

[57] ABSTRACT

A lubricating oil composition comprising a major portion of a lubricating oil and a minor amount of an additive. The additive is prepared by reacting a polyamine with an alkenyl succinic acid anhydride having a number average molecular weight of about 500 to about 10,000 at a temperature of 60° C.–120° C. to form mono-alkenyl succinimide, bis-alkenyl succinimide or a mixture of mono- and bis-alkenyl succinimide. 2-pyrrolidone-5-carboxylic acid is then added to form an acylated mono-alkenyl succinimide, bis-alkenyl succinimide or mixture of mono- and bis-alkenyl succinimide. The acylated mono-alkenyl succinimide, bis-alkenyl succinimide or mixture of mono- and bis-alkenyl succinimide is acylated with an acylating compound selected from the group consisting of glycolic acid, oxalic acid, lactic acid, 2-hydroxymethyl-propionic acid and 2,2-bis(hydroxymethyl) propionic acid at a temperature of about 150° C. to about 185° C., to form a mixed acylated mono-alkenyl succinimide, bis-alkenyl succinimide or mixture of mono- and bis-alkenyl succinimide and the mixed acylated mono-alkenyl succinimide, bis-alkenyl succinimide or mixture of mono- and bis-alkenyl succinimide is recovered.

7 Claims, No Drawings

ACYLATED MONO AND/OR BIS-SUCCINIMIDES LUBRICATING OIL ADDITIVES

This is a continuation of co-pending application Ser. No. 07/636,479, filed on Dec. 31, 1990, now abandoned.

BACKGROUND OF THE INVENTION

This invention is related to lubricating oil additives, and more particularly to mono and/or bis-succinimide multipurpose lubricating oil additives.

It is well known that internal combustion engines operate under a wide range of temperatures including low temperature stop-and-go- service as well as high temperature conditions produced by continuous high speed driving. Stop-and-go driving, particularly during cold, damp weather conditions, leads to the formation of a sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkyl succinimide or an alkenylsuccinamic acid as determined by selected conditions of reaction.

It is also known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6- and 8-cylinder engines in order to produce the required torque output, it has become increasingly difficult to provide a satisfactory dispersant lubricating oil composition.

Another problem facing the lubricant manufacturer is that of seal deteriorating in the engine. All internal combustion engines use elastomer seals, such as Viton seals, in their assembly. Over time, these seals are susceptible to serious deterioration caused by the lubricating oil composition. A lubricating oil composition that degrades the elastomer seals in an engine is unacceptable to engine manufacturers and has limited value.

Thus, an object of the present invention is to provide a lubricating oil composition having dispersancy and Viton seal compatibility.

Another object is to provide a lubricating oil composition which can withstand the stresses imposed by modern internal combustion engines.

A still further object is to provide a novel lubricating oil composition which does not degrade elastomer seals in internal combustion engines.

DISCLOSURE STATEMENT

U.S. Pat. Nos. 3,172,892 and 4,048,080 disclose alkenylsuccinimides formed from the reaction of an alkyne succinic anhydride and an alkylene polyamine and their use as dispersants in a lubricating oil composition.

U.S. Pat. No. 2,568,876 discloses reaction products prepared by reacting a monocarboxylic acid with a polyalkylene polyamine followed by a reaction of the intermediate product with an alkenyl succinic acid anhydride.

U.S. Pat. No. 3,216,936 discloses a process for preparing an aliphatic amine lubricant additive which involves reacting an alkylene amine, a polymer substituted succinic acid and an aliphatic monocarboxylic acid.

U.S. Pat. No. 3,13 1,150 discloses lubricating oil compositions containing dispersant-detergent mono- and dialkyl-succinimides or bis(alkenylsuccinimides).

Netherlands Patent 7,509,289 discloses the reaction product of an alkenyl succinic anhydride and an aminoalcohol, namely, a tris(hydroxymethyl) aminomethane.

U.S. patent application, Ser. No. 334,774, filed on Dec. 28, 1981, now U.S. Pat. No. 4,579,674 discloses a hydrocarbyl-substituted succinimide dispersant having a secondary hydroxy-substituted diamine or polyamine segment and a lubricating oil composition containing same.

U.S. Pat. No. 4,338,205 discloses alkenyl succinimide and borated alkenyl succinimide dispersants for a lubricating oil with impaired diesel dispersancy in which the dispersant is treated with an oil-soluble strong acid.

The disclosures of U.S. Pat. No. 3,172,892 and of U.S. patent applications, Ser. Nos. 334,774, now U.S. Pat. No. 4,579,674 and U.S. Pat. No. 4,048,080 are incorporated herein by reference.

SUMMARY OF THE INVENTION

The present invention provides a novel additive which improves the dispersancy and Viton seal compatibility of a lubricating oil. The lubricating oil composition comprises a major portion of a lubricating oil and a minor dispersant amount of a reaction product (i.e., lubricant additive) which may be prepared as set forth below.

PROCESS

A process for preparing a lubricating oil additive comprising:

(a) reacting an amine with an alkenyl succinic acid anhydride to form a mono- and/or bis-alkenyl succinimide;

(b) adding a pyrrolidone carboxylic acid to the mono- and/or bis-alkenyl succinimide to form an acylated mono- and/or bis-alkenyl succinimide;

(c) acylating the acylated mono- and/or bis-alkenyl succinimide with an acylating agent, thereby forming a mixed acylated bis-alkenyl succinimide; and (d) recovering the mixed acylated mono- and/or bis-alkenyl succinimide.

DETAILED DESCRIPTION OF THE INVENTION

In carrying out the present process, the reactants are step wise reacted with a long chain hydrocarbyl substituted dicarboxylic acid anhydride containing residual unsaturation in a "one pot reaction". The long chain hydrocarbon group is a ($C_2$–$C_{10}$) polymer, e.g., a ($C_2$–$C_5$) monoolefin, the polymer having a number average molecular weight (Mn) of about 500 to about 10,000.

The preferred olefin polymers for the reaction with the unsaturated dicarboxylic acid anhydride or ester are polymers comprising a major molar amount of ($C_2$–$C_{10}$) polymer, e.g., a ($C_2$–$C_5$) monoolefin.

Such olefins include ethylene, propylene, butylene, isobutylene, pentane, 1-octane, styrene, etc. The polymers can be homopolymers such as polyisobutylene, as well as copolymers of two or more of such olefins such as copolymers of: ethylene and propylene, butylene and isobutylene, propylene and isobutylene, etc. Other copolymers include those in which a minor molar amount of the copolymer monomers e.g., 1 to 10 mole % is a ($C_4$–$C_{10}$) non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight. In this case the alpha- or beta-unsaturated dicarboxylic acid anhydride is reacted with the saturated ethylene-propylene copolymer utilizing a radical initiator.

The long chain hydrocarbyl substituted dicarboxylic acid producing material, e.g., acid or anhydride used in the invention includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumarate, chloromaleic anhydride and mixtures thereof.

The alkenyl succinic acid anhydride is characterized by the following formula:

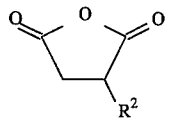

wherein the backbone polymer, $R^1$, is a residue (containing residual unsaturation) from a polyolefin which was reacted with maleic acid anhydride to for the alkenyl succinic acid anhydride. $R^1$ may have a number average molecular weight (Mn) ranging from about 500–10,000, preferably about 1000– 5000, and more preferably from about 2000–2500.

The polyamine compositions which may be employed in practicing the present invention may include primary and/or secondary amines. The amines may typically be characterized by the formula

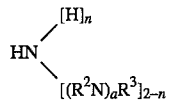

In this formula, a may be an integer of about 3 to about 8, preferably about 5; and may be 0 or 1; and n is 0 or 1. In the above compound, $R^3$ may be hydrogen or a hydrocarbon group selected from the group consisting of alkyl, aralkyl, cycloalkyl, aryl, alkaryl, alkenyl, and alkyl, including such radicals when inertly substituted. The preferred $R^3$ groups may be hydrogen or lower alkyl group, i.e. $C_1$–$C_{10}$ alkyl, groups including e.g., methyl, ethyl, n-propyl, ipropyl, butyls, amyls, hexyls, octyls, decyls, etc. $R^3$ is preferably hydrogen. $R^2$ may be a hydrocarbon selected from the same group as $R^3$ subject to the fact that $R^2$ is divalent and contains one less hydrogen. Preferably $R^3$ is hydrogen and $R^2$ is —$CH^2CH^2$—. Typical amines which may be employed may include those enlisted below in Table 1.

TABLE 1 diethylenetriamine (DETA)
triethylenetetramine (TETA)
tetraethylenepentamine (TEPA)
pentaethylenehexamine (PEHA)

In the present process, the acylated mono- and/or bis-alkenyl succinimide is usually acylated with an alternative acylating compound to form a mixed acylated mono- and/or bis-alkenyl succinimide. However, in the present process, instead of acylating the acylated mono- and/or bis-alkenyl succinimide the succinimide may be borated with an borating agent to form a borated acylated mono- and/or bis-alkenyl succinimide.

The borating agent is selected from the group consisting of boric acid, boron oxide, boron halide, and a boron acid ester, to provide a borated derivative thereof.

The secondary amine groups of the polyalkenylamine moiety in said acylated mono- and/or bis-alkenyl succinimide are reacted with a pyrrolidone carboxylic acid or its ester derivative represented by the formula:

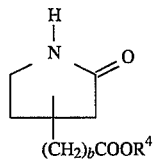

where $R^4$ may be hydrogen or a hydrocarbon group selected from the group consisting of alkyl, aralkyl, cycloalkyl, aryl, alkaryl, alkenyl, and alkynyl, including such radicals when inertly substituted. The preferred $R^4$ groups may be hydrogen or lower alkyl group, i.e. $C_1$–$C_{10}$ alkyl, groups including e.g. methyl, ethyl, n-propyl, i-propyl, butyls, amyls, hexyls, octyls, decyls, etc. $R^4$ may preferably be hydrogen. In this formula, b may be an integer of about 0 to about 12, preferably 0. A preferred compound is 2-pyrrolidone- 5-carboxylic acid.

As suggested above, the secondary amine groups of the polyalkenylamine moiety in the acylated mono- and/or bis-alkenyl succinimide are reacted with either an alternative acylating and/or a borating agent.

The acylating agent may be a carboxylic acid such as a hydroxyaliphatic acid or a fatty acid. The suitable fatty acids are straight chain compounds, ranging from 3 to 18 carbons. They may be saturated or unsaturated. Saturated acids include lauric, myristic, pentadecanoic, palmitic, margaric and stearic. Unsaturated acids include myristoleic, palmitoleic, oleic, linoleic and linolenic.

The hydroxyaliphatic acid preferably used as an acylating agent is a carboxylic acid characterized by the formula HO—$R^5$—COOH, wherein $R^5$ is an alkyl group having from about 1 to about 4 carbon atoms and the hydroxyl group can be located at any available position therein.

The preferred acylating agents are glycolic acid, oxalic acids, lactic acid, 2-hydroxymethylpropionic acid and 2,2-bis(hydroxymethyl)propionic acid, the most preferred being glycolic acid.

It is understood that equivalents of the carboxylic acids prescribed, namely their anhydrides, esters and acyl halides, can also be employed in the practice of this invention. A characteristic of the preferred $C_2$ and $C_3$ hydroxyaliphatic carboxylic acids is their relatively limited or negligible solubility in mineral oil.

The lubricating oil of the present invention will contain the novel reaction product in a concentration ranging from about 0.1 to 30 weight percent. A concentration range for the additive ranging from about 0.5 to 15 weight percent based on the total weight of the oil composition is preferred with a still more preferred concentration range being from about 1 to 8.0 weight percent. Oil concentrates of the additives may contain from about 1 to 75 weight percent of the additive reaction product in a carrier or diluent oil of lubricating oil viscosity.

The reaction product of the present invention may be employed in lubricant compositions together with conventional lubricant additives. Such additives may include additional dispersants, detergents, antioxidants, pour point depressants, anti-wear agents and the like.

The additive reaction product of the present invention was tested for its effectiveness as a dispersant and for Viton seal compatibility in a fully formulated lubricating oil composition.

The above process and products are illustrated in the Examples below and by reviewing such Examples the present invention and its advantages will be more apparent.

EXAMPLE I

Preparation Of Acylated Mono- And/Or Bis-Alkenyl Succinimide Dispersant

A solution of polyisobutenylsuccinic acid anhydride (3965.0 g, 1.0 moles, PIBSA prepared from an approximately 2060 mol. wt. polybutene) in diluent oil (2401.3 g) was charged into a twelve liter 3-neck flask equipped with a mechanical stirrer, thermometer, thermocouple, and nitrogen inlet and heated to 60° C. Next pentaethylenehexamine (145.2 g, 0.55 moles) was added and the heat was increased to 120° C. and maintained for 2.0 hours. Then 2-pyrrolidone-5-carboxylic acid (212.9 g, 1.65 moles) was added and the temperature was raised and maintained at 185° C. for 4 hours to drive off water. The hot mixture (~100° C.) was filtered through diatomaceous earth filter aid. The product (an approximately 50% concentrate) analyzed as follows: % N=1.08 (0.90 calc.) and Total Acid Number (TAN)=3.1.

EXAMPLE II

Preparation Of Mixed Acylated Mono- And/Or Bis-Alkenyl Succinimide Dispersant A solution of polyisobutenylsuccinic acid anhydride (3965.0 g, 1.0 moles, PIBSA prepared from an approximately 2060 mol. wt. polybutene) in diluent oil (3060.1 g) was charged into a twelve liter 3-neck flask equipped with a mechanical stirrer, thermometer, thermocouple, and nitrogen inlet and heated to 60° C. Next pentaethylenehexamine (145.2 g, 0.55 moles) was added and the heat was increased to 120° C. and maintained for 2.0 hours. Then 2-pyrrolidone-5-carboxylic acid (71.0 g, 0.55 moles) was added and the temperature was raised and maintained at 160° C. for 2 hours. The reactor was cooled to 120° C. and a 70% solution of glycolic acid (108.0 g, 1.00 moles) was added. The reactor was heated to 160° C. and maintained 4 hours to drive off water. The hot mixture (~100° C.) was filtered through diatomaceous earth filter aid. The product (an approximately 50% concentrate) analyzed as follows: % N=0.85 (0.79 calc.), Total Acid Number (TAN)=3.2, and Total Base Number (TBN)= 9.9.

EXAMPLE III

Preparation Of Acylated Mono- And/Or Bis-Alkenyl Succinimide Dispersant (Comparative Example)

A solution of polyisobutenylsuccinic acid anhydride (3965.0 g, 1.0 moles, PIBSA prepared from an approximately 2060 mol. wt. polybutene) in diluent oil (2283.5 g) was charged into a twelve liter 3-neck flask equipped with a mechanical stirrer, thermometer, thermocouple, and nitrogen inlet and heated to 60 ° C. Next pentaethylenehexamine (145.2 g, 0.55 moles) was added and the heat was increased to 120° C. and maintained for 2.0 hours. Then a 70% solution of glycolic acid (213.8 g, 1.98 moles) was added. The reactor was heated to 160° C. and maintained 4 hours to drive off water. The hot mixture (~ 100 ° C.) was filtered through diatomaceous earth filter aid. The product (an approximately 50% concentrate) analyzed as follows: % N=0.71 (0.71 calc.) and Total Acid Number (TAN)= 2.9.

EXAMPLE IV

Sequence VE Gasoline Engine Test Results

The ASTM Sequence VE gasoline engine test is used to evaluate the performance of gasoline engine oils in protecting engine parts from sludge and varnish deposits and valve train wear due to low temperature "stop and go" operation. The test uses a Ford 2.3 L four-cylinder Ranger truck engine. The engine is cycled through three test stages, requiring four hours to complete, for 288 hours or 72 cycles. The Sequence VE gasoline engine test are results shown below in Table 2 were run in a single grade fully formulated motor oil.

TABLE 2

| | Sequence VE Gasoline Engine Test Results | | | | | | | |
|---|---|---|---|---|---|---|---|---|
| Dispersant | AS[1] | AV | RACS | PSV | % ORC | % OSC | $CLW_{avg}$ | $CLW_{max}$ |
| Example[2] 1 | 9.6 | 4.5 | 9.5 | 7.1 | 0.0 | 0.0 | 1.3 | 1.5 |
| Example[2] 2 | 9.6 | 4.5 | 9.5 | 7.1 | 0.0 | 0.0 | 0.4 | 0.6 |
| Example[2] 3 (Comparative) | 8.9 | 4.7 | 8.5 | 6.8 | 35.0 | 0.0 | 1.2 | 1.5 |
| Limits | $9.0_{min}$ | $5.0_{min}$ | $7.0_{min}$ | $6.5_{min}$ | $15.0_{max}$ | $20.0_{max}$ | $5_{max}$ | $15_{max}$ |

[1]AS, AV, RACS, PSV, ORC, OSC, $CLW_{avg}$, and $CLW_{max}$ denote: average sludge, average varnish, rocker arm cover sludge, piston skirt varnish, oil ring clogging, oil screen clogging, cam lobe wear average, and cam lobe wear maximum, respectively.
[2]SAE 30 fully formulated motor oil

EXAMPLE V

Bench Sludge Test

This test is conducted by heating the test oil mixed with synthetic hydrocarbon blow by and a diluent oil at a fixed temperature for a fixed time period. After heating, the turbidity of the resulting mixture is measured. A low percentage turbidity (20–40) is indicative of good dispersancy while a high value (40 to 200) is inductive of an oil's increasingly poor dispersancy. The results obtained with the known and present dispersants are set forth below in Table 3 below at 6.5% percent by weight concentration, in a SAE 30W fully formulated motor oil.

TABLE 3

| Bench Sludge Test Results | | | | | |
|---|---|---|---|---|---|
| | | Rating References | | | |
| Dispersant | Results | SG | good | fair | poor |
| Example 1 | 29 | 32 | 36 | 65 | 105 |
| Example 2 | 19 | 18 | 20 | 28 | 66 |

EXAMPLE VI

Viton Seal Compatibility

The test described below is designed to test the Viton seal compatibility for a crankcase lubricating oil composition containing a nitrogen-containing dispersant. The Viton AK-6 seal is soaked at 302° F. for 168 hours in the oil being tested. The elastomer to oil ratio is 1/80. Then the sample is tested for percent change in elongation, percent change in tensile strength, and the degree of cracking. The dispersant is in the oil formulation at 6.5 weight percent. The results are shown below in Table 4.

TABLE 4

| Viton Seal Compatibility Test Results | | | |
|---|---|---|---|
| Limits | Example 1 | Example 2 | Limits |
| % Change in Tensile Strength | −8.3 | −11.5 | +/−20 max |
| % Change in Elongation | −14.9 | −9.4 | +/−25 max |
| Cracks at 120% Elongation | none | none | none |

EXAMPLE VII

MWM-B Diesel Engine Test Results

The MWM-B engine test used to evaluate the performance of diesel engine oils. The test uses a 1 cylinder engine that runs for 50 hours. The piston is rated for cleanliness utilizing a merit system. The rating scale goes from 0 to 80, with 80 being perfectly clean piston. The results below in Table 5 were obtained in a SAE 30W fully formulated motor oil.

TABLE 5

| Diesel Engine Test Results | | |
|---|---|---|
| Dispersant | Engine | Result |
| Example 1 | MWM-B | 63 merits, 62% TGF[1] |

TABLE 5-continued

| Diesel Engine Test Results | | |
|---|---|---|
| Dispersant | Engine | Result |
| Example 2 | MWM-B | 71 merits, 68% TGF[1] |

[1]Top Grove Fill

We claim:

1. A lubricating oil composition comprising a major portion of a lubricating oil and a minor amount of reaction product prepared the process comprising:

(a) reacting a polyamine with an alkenyl succinic acid anhydride having a number average molecular weight of about to about 10,000 at a temperature of 60° C.–120° C. to form mono-alkenyl succinimide, bis-alkenyl succinimide or a mixture of mono- and bis-alkenyl succinimide;

(b) adding 2-pyrrolidone-5-carboxylic acid to the mono-alkenyl succinimide, bis-alkenyl succinimide or mixture of mono- and bis-alkenyl succinimide to form an acylated mono-alkenyl succinimide, bis-alkenyl succinimide or mixture of mono- and bis-alkenyl succinimide;

(c) acylating said acylated mono-alkenyl succinimide, bis-alkenyl succinimide or mixture of mono- and bis-alkenyl succinimide with an acylating compound selected from the group consisting of glycolic acid, oxalic acid, lactic acid, 2-hydroxymethyl-propionic acid and 2,2-bis(hydroxymethyl) propionic acid at a temperature of about 150° C. to about 185 ° C., thereby forming a mixed acylated mono-alkenyl succinimide, bis-alkenyl succinimide or mixture of mono- and bis-alkenyl succinimide; and (d) recovering said mixed acylated mono-alkenyl succinimide, bis-alkenyl succinimide or mixture of mono- and bis-alkenyl succinimide.

2. The lubricating oil composition of claim 1, wherein said amine is represented by the formula

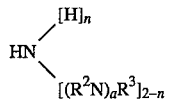

where $R^3$ is H or a hydrocarbon selected from the group consisting of alkyl, aralkyl, cycloalkyl, aryl, alkaryl, alkenyl and alkynyl group; $R^2$ is a hydrocarbon selected from the same group as $R^3$ except that $R^2$ contains one less H; a is an integer of about 3 to about 8; and n is 0 or 1.

3. The lubricating oil composition of claim 1, wherein said polyamine is selected from the group consisting of diethylenetriamine, triethylenetetramine, tetraethylenepentamine and pentaethylenehexamine.

4. The lubricating oil composition of claim 2, wherein said polyamine is tetraethylenepentamine.

5. The lubricating oil composition of claim 2, wherein said polyamine is pentaethylenehexamine.

6. The lubricating oil composition of claim 2, wherein said amine is triethylenetetramine.

7. The lubricating oil composition of claim 1, wherein said acylating compound is glycolic acid.

* * * * *